US012290726B2

(12) United States Patent
Fujiwara et al.

(10) Patent No.: US 12,290,726 B2
(45) **Date of Patent: *May 6, 2025**

(54) GOLF SHAFT

(71) Applicant: NHK SPRING CO., LTD., Yokohama (JP)

(72) Inventors: Kosuke Fujiwara, Yokohama (JP); Akihisa Inoue, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 779 days.

This patent is subject to a terminal disclaimer.

(21) Appl. No.: 17/298,179

(22) PCT Filed: Oct. 18, 2019

(86) PCT No.: PCT/JP2019/041117
§ 371 (c)(1),
(2) Date: May 28, 2021

(87) PCT Pub. No.: WO2020/129387
PCT Pub. Date: Jun. 25, 2020

(65) Prior Publication Data

US 2022/0111271 A1 Apr. 14, 2022

(30) Foreign Application Priority Data

Dec. 21, 2018 (JP) ..... 2018-240263

(51) Int. Cl.
*A63B 53/10* (2015.01)
*A63B 53/12* (2015.01)

(52) U.S. Cl.
CPC ..... *A63B 53/10* (2013.01); *A63B 53/12* (2013.01)

(58) Field of Classification Search
CPC ..... A63B 53/10; A63B 53/12
See application file for complete search history.

(56) References Cited

U.S. PATENT DOCUMENTS 2,809,144 A * 10/1957 Grimes ..... B29C 53/562 156/289
5,259,614 A * 11/1993 Greer ..... A63B 60/00 273/DIG. 7

(Continued)

FOREIGN PATENT DOCUMENTS

GB 2566889 A 3/2019
JP 58-94867 A 6/1983

(Continued)

OTHER PUBLICATIONS

British Office Action issued May 20, 2022 in British Application No. GB2107509.8.

*Primary Examiner* — John E Simms, Jr.
(74) *Attorney, Agent, or Firm* — Norris McLaughlin, P.A.

(57) ABSTRACT

Provided is a golf shaft, capable of ensuring bending rigidity required for a golf club and providing good hit feeling in a composite shaft with 50 g-130 g. The golf shaft comprises an element tube made of metal, an outer layer made of a fiber reinforced plastic and covering an outer periphery of the element tube over an entire length of the element tube in an axial direction, an adhesive layer interposed between the element tube and the outer layer to bond between the element tube and the outer layer, wherein weight of a whole including the element tube, the outer layer, and the adhesive layer is 50 g-130 g, and weight of the element tube is 50%-90% of the weight of the whole.

5 Claims, 6 Drawing Sheets

(56) References Cited

U.S. PATENT DOCUMENTS

| | | | | |
|---|---|---|---|---|
| 7,128,664 | B2 * | 10/2006 | Onoda | A63B 53/0466 473/347 |
| 9,717,963 | B2 * | 8/2017 | Naito | B29C 70/202 |
| 2002/0119829 | A1 * | 8/2002 | Cheng | A63B 60/52 473/316 |
| 2010/0160065 | A1 * | 6/2010 | Bone | A63B 60/42 473/409 |
| 2020/0108300 | A1 | 4/2020 | Fujiwara | |

FOREIGN PATENT DOCUMENTS

| | | | | |
|---|---|---|---|---|
| JP | 62-128563 | A | 8/1987 | |
| JP | 5-034672 | Y2 | 9/1993 | |
| WO | WO-9928004 | A1 * | 6/1999 | A63B 53/12 |

* cited by examiner

| WEIGHT RATIO 50% | | THICKNESS (mm) | | |
|---|---|---|---|---|
| | | OUTER LAYER | ELEMENT TUBE | WHOLE |
| 50g | 45in | 0.25 | 0.05 | 0.30 |
| | 40in | 0.28 | 0.06 | 0.34 |
| | 35in | 0.32 | 0.06 | 0.39 |
| 130g | 45in | 1.00 | 0.20 | 1.20 |
| | 40in | 1.13 | 0.23 | 1.35 |
| | 35in | 1.29 | 0.26 | 1.54 |

GOLF SHAFT

FIELD OF THE INVENTION

The present invention relates to a golf shaft in which an element tube made of metal is covered with an outer layer made of a fiber reinforced plastic.

BACKGROUND OF THE INVENTION

As a golf shaft, there is a composite shaft, as disclosed in JP H05-34672Y, in which an element tube made of metal is thinned and its outer periphery is covered with an outer layer made of a fiber reinforced plastic in order to reduce weight while remaining hit feeling of a golf shaft made of metal.

In such a composite golf shaft, there is a problem that, if weight is reduced to approximate 50 g-130 g, it is hard to ensure bending rigidity required for a golf club and hit feeling is deteriorated although it depends on length.

SUMMARY OF THE INVENTION

A problem to be solved is that it is hard to ensure bending rigidity required for a golf club and hit feeling is deteriorated in a composite shaft with 50 g-130 g.

The present invention provides a golf shaft, capable of ensuring bending rigidity required for a golf club and providing good hit feeling in a composite shaft with 50 g-130 g. The golf shaft of the present invention is provided with an element tube made of metal, an outer layer made of a fiber reinforced plastic and covering an outer periphery of the element tube over an entire length of the element tube in an axial direction, an adhesive layer interposed between the element tube and the outer layer to bond between the element tube and the outer layer, wherein weight of a whole including the element tube, the outer layer, and the adhesive layer is 50 g-130 g, and weight of the element tube is 50%-90% of the weight of the whole.

The present invention ensures bending rigidity required for a golf club and provides good hit feeling in a composite shaft with 50 g-130 g.

BRIEF DESCRIPTION OF THE DRAWINGS

FIGS. 1(A) and 1(B) are side views of a golf shaft according to an embodiment 1 of the present invention in which FIG. 1(A) illustrates a whole of the golf shaft and FIG. 1(B) illustrates an enlarged part of FIG. 1(A);

EMBODIMENT FOR CARRYING OUT THE INVENTION

The present invention accomplishes the object of ensuring bending rigidity required for a golf club and providing good hit feeling in a composite shaft with 50 g-130 g by that weight of an element tube made of metal and covered over an entire length in an axial direction with an outer layer made of a fiber reinforced plastic is 50%-90% of weight of a whole of a golf shaft.

Figure 1:
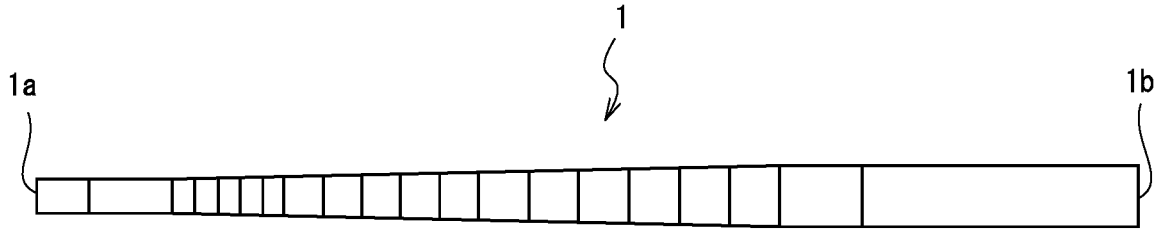
Figure 1:
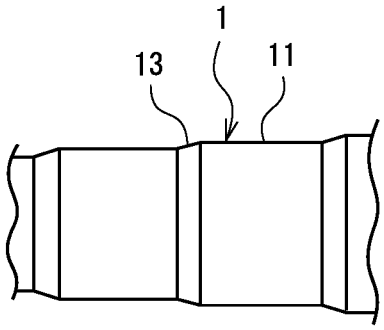
Figure 2:
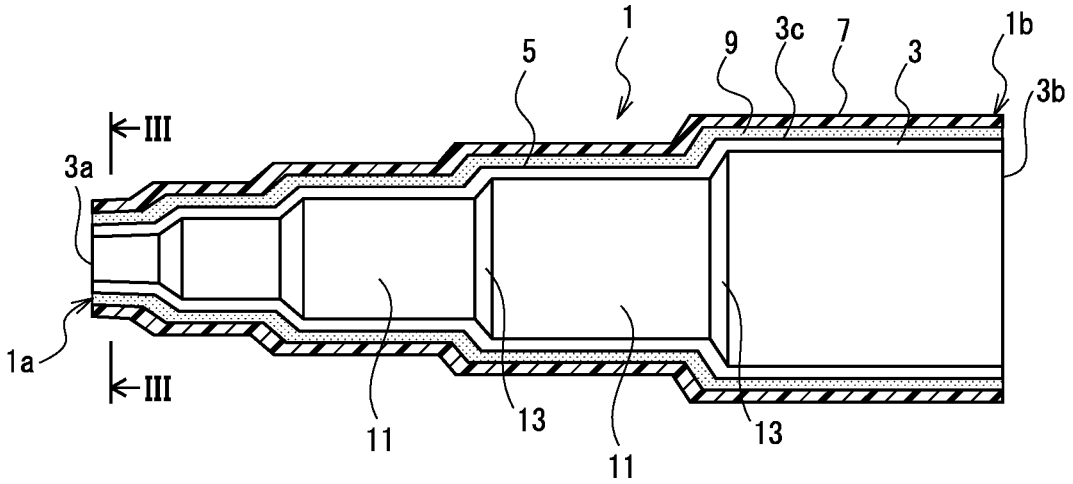
FIG. 2 is a schematic longitudinal sectional view of the golf shaft of FIG. 1.
Figures 3, 4:
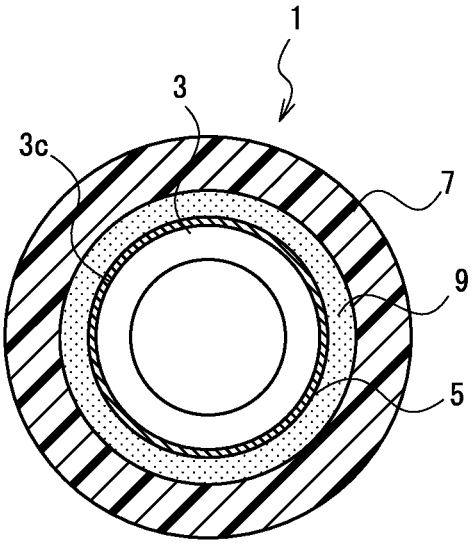
FIG. 3 is a schematic cross sectional view of the golf shaft taken along a line of FIG. 2.
FIG. 4 is a table illustrating wall thicknesses of an outer layer, an element tube, and a whole in a case that a ratio of weight of the element tube is 50% in the golf shaft of FIG. 1.

FIGS. 1(A) and 1(B) are side views of a golf shaft in which FIG. 1(A) illustrates a whole of the golf shaft and FIG. 1(B) illustrates an enlarged part of FIG. 1(A). FIG. 2 is a schematic longitudinal sectional view of the golf shaft of FIG. 1. FIG. 3 is a schematic cross sectional view of the golf shaft taken along a line of FIG. 2. It should be noted that, though FIGS. 1-3 do not correspond with each other in dimension of each part, they are basically the same structure.

A golf shaft 1 is formed into a tube, a front end 1*a* in an axial direction of which is a portion to which a head of a golf club is attached and a base end 1*b* in the axial direction of which is a portion to which a grip of the golf club is attached.

Weight of the whole of the golf shaft 1 is set to 50 g-130 g. According to the present embodiment, the golf shaft 1 is set to about 90 g. A length from the front end 1*a* to the base end 1*b* of the golf shaft 1 is 41 inches, but is not limited thereto.

The golf shaft 1 of the present embodiment is a composite shaft and is configured to be provided with an element tube 3, a plating layer 5, an outer layer 7, and an adhesive layer 9.

The element tube 3 comprises a hollow tubular shaft made of metal, a sectional shape in a cross section of which is circular. The element tube 3 of the present embodiment is made of steel. The element tube 3 may be, however, formed of the other metal, for example, aluminum alloy, titan or the like.

Weight of the element tube 3 is 50%-90% of the weight of the whole of the golf shaft 1. According to the present embodiment, the weight of the element tube 3 is about 70 g and the weight of the whole of the golf shaft 1 is about 90 g, so that the weight of the element tube 3 is about 77.78% of the weight of the whole of the golf shaft 1.

It should be noted that a weight ratio of the element tube 3 should be appropriately set within the above range of 50%-90% in view of parameters of the golf shaft 1 such as the length of the element tube 3 (golf shaft 1), the longitudinal sectional view of the element tube 3, bending rigidity and weight of the outer layer 7 and the adhesive layer 9.

The element tube 3 of the present embodiment has a stepped shape formed by a plurality of straight tube parts 11 and a plurality of tapered tube parts 13 connecting adjacent straight tube parts 11.

The straight tube part 11 is a portion at which a wall thickness and diameters of inner and outer peripheries are constant. In adjacent straight tube parts 11, the straight tube part 11 located on a side of a butt end 3*b* has larger diameters of inner and outer peripheries and a thinner wall thickness than of the straight tube part 11 located on a side of a tip end 3*a* of the element tube 3.

Each tapered tube part 13 is to absorb differences in diameter and wall thickness between adjacent straight tube parts 11. Each tapered tube part 13 gradually increases in the diameters of the inner and outer peripheries and becomes gradually thin in the wall thickness from the side on the tip end 3*a* toward the side on the butt end 3*b*. A length of the tapered tube part 13 in the axial direction is shorter than of the straight tube part 11.

In the element tube 3 of the present embodiment, the outer diameter is 14.50 mm at the largest portion and the wall thickness of that portion is 0.206 mm. On the other hand, the outer diameter is 8.00 mm at the smallest portion and the wall thickness of that portion is 0.294 mm.

It should be noted that the element tube 3 is not limited to the stepped shape, but it may be formed into a straight shape with a constant diameter of the outer periphery or an entirely tapered tubular shape. Further, the wall thickness of the element tube 3 may be constant in the axial direction or partially altered. Furthermore, the sectional shape in the cross section of the element tube 3 is not limited to the circular shape and may be an oval shape or the like appropriately selected.

The plating layer 5 is provided on a whole outer peripheral surface 3*c* of the element tube 3 and forms a top surface of the element tube 3. In addition, the plating layer 5 is provided for rust prevention or the like of the element tube 3, and may be replaced with other treatments such as alumite treatment, anodic oxidation treatment, and chemical conversion treatment, or may be omitted.

The plating layer 5 may be a plating of, for example, copper, nickel, chrome, zinc, tin, gold or the like. According to the present embodiment, the plating layer 5 is configured by applying a chrome plating besides two nickel platings are stacked.

A wall thickness of the plating layer 5 is very thin relative to the wall thickness of the element tube 3, and is about 0.0103 mm being the sum of each nickel plating that is 0.005 mm and the chrome plating that is 0.0003 mm. The wall thickness of the plating layer 5 is, however, not limited thereto.

The outer layer 7 is a fiber reinforced plastic covering the outer periphery (plating layer 5) of the element tube 3 over the entire length of the element tube 3 in the axial direction. It should be noted that the "covering the outer periphery of the element tube 3" means covering the element tube 3 entirely in a circumferential direction. The outer layer 7 is, therefore, formed into a tube.

The material of the outer layer 7 is not limited particularly, but is formed of a fiber reinforced plastic in which a matrix resin is an epoxy resin and a reinforcement is a fiber sheet in the present embodiment.

Figure 5:
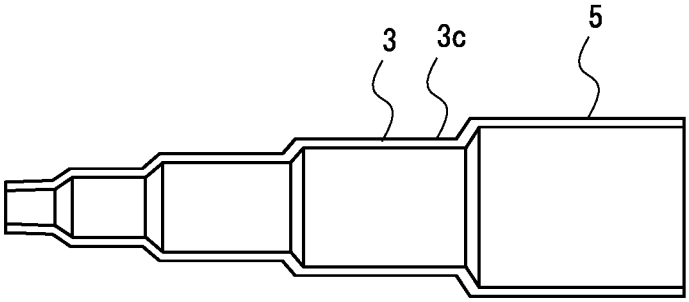
FIGS. 5(A)-(D) are schematic longitudinal sectional views illustrating manufacturing process of the golf shaft according to the embodiment 1 of the present invention.
Figure 5:
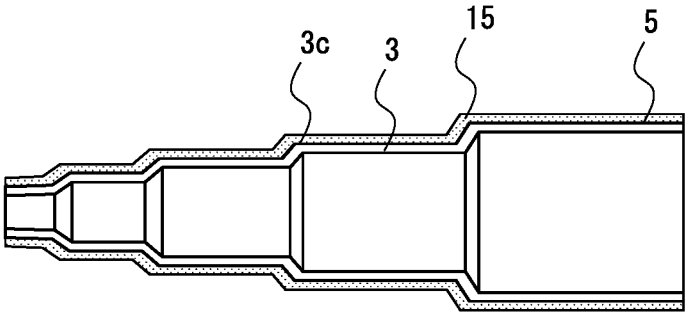
Figure 5:
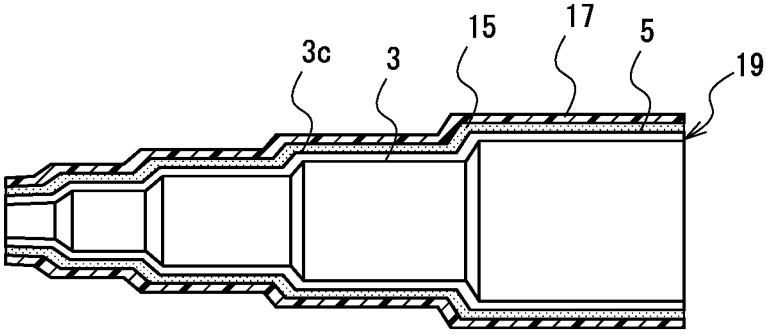
Figure 5:
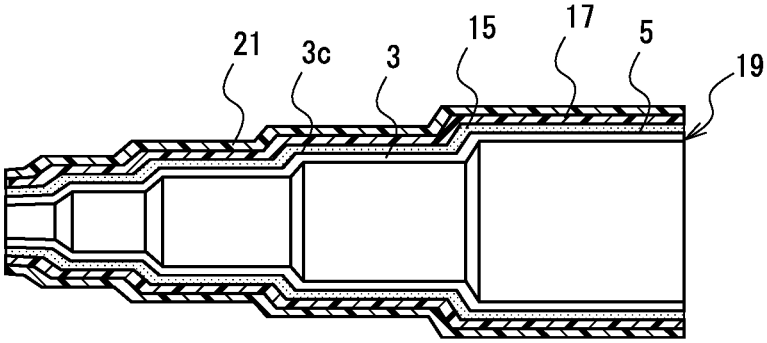

The outer layer 7 of the present embodiment is formed by winding prepregs 17 explained later (FIGS. 5 and 6) around the element tube 3 through the adhesive layer 9 and heating them. The prepreg 17 is a fiber reinforced plastic sheet in which a resin (epoxy resin in the present embodiment) containing a curing agent is impregnated into a fiber sheet.

The curing agent used for the outer layer 7 is selected one of aliphatic polyamine, alicyclic polyamine, aromatic polyamine, polyamideamine or the like according to the present embodiment, but it is not limited thereto.

For the fiber sheet, various fiber sheets may be employed, and, for example, sheets of inorganic fiber such as metal fiber, boron fiber, carbon fiber, glass fiber and ceramics fiber, aramid fiber, other high tension synthetic fibers or the like may be used. The inorganic fiber is preferably used because it is lightweight and has high tension. In particular, the carbon fiber has superior specific strength and specific rigidity and is the most suitable. The present embodiment, therefore, uses the carbon fiber sheet as the fiber sheet.

It should be noted that the outer layer 7 in FIG. 1 is formed so as to follow the plating layer 5 and has a stepped shape. The outer layer 7, however, is cut at the time of manufacturing the golf shaft 1 and therefore may not actually have the stepped shape according to a cutting condition in many cases.

Accordingly, the wall thickness of the outer layer 7 alters in the axial direction and is set within a range thicker than the wall thickness of the element tube 3. According to the present embodiment, the wall thickness of the outer layer 7 is about 0.700 mm at the thickest portion and is about 0.330 mm at the thinnest portion. The wall thickness of the outer layer 7 may be, however, in a range of 1.300 mm-0.200 mm according to design.

The adhesive layer 9 is interposed between the element tube 3 and the outer layer 7 and has a tubular shape bonding between the element tube 3 and the outer layer 7. The adhesive layer 9 of the present embodiment is formed so as to follow the plating layer 5 on the outer periphery of the element tube 3 and has a stepped shape.

A wall thickness of the adhesive layer 9 is approximately constant and is thinner than the wall thicknesses of the outer layer 7 and the element tube 3. The wall thickness of the adhesive layer 9 of the present embodiment is approximate 0.02 mm. The wall thickness of the adhesive layer 9 is not limited thereto, but it may be altered within a range capable of bonding between the element tube 3 and the outer layer 7.

The adhesive layer 9 is not particularly limited, but is preferably one having high adhesion relative to the plating layer 5 on the outer periphery of the element tube 3 and the outer layer 7. The adhesive layer of the present embodiment comprises an epoxy resin composition including an epoxy resin and a mixed curing agent in which two or more kinds of amine-based curing agents are mixed. The adhesive layer 9 has higher adhesion relative to the plating layer 5 and the outer layer 7 than adhesion for directly bonding the plating layer 5 and the outer layer 7.

For the adhesive layer 9 of the present embodiment, a clear paint is used. In particular, it is formed by heating and curing an adhesive layer agent 15 (FIG. 5) in which a liquid epoxy resin and a liquid mixed curing agent of the clear paint are mixed in a ratio of 2 to 1.

The liquid epoxy resin contains 73.96% (weight) resin component, 25.77% (weight) solvent, and 0.27% (weight) additive. The liquid curing agent contains 64.82% (weight) resin component, 26.82% (weight) solvent, and 8.36% (weight) additive.

The uncured adhesive layer agent 15, therefore, contains approximate 70% (weight) resin component, approximate 26% (weight) solvent, and approximate 3% (weight) additive according to the above mixing. It should be noted that the above content ratio of the components is an example and may be changed appropriately.

The resin component of the adhesive layer agent comprises the epoxy resin and the amine-based curing agents. As the amine-based curing agents, there are, for example, aliphatic polyamine, alicyclic polyamine, aromatic polyamine, polyamideamine and the like. The two or more kinds of the amine-based curing agents are two or more different kinds of amine-based curing agents selected from the amine-based curing agents.

According to the present embodiment, two kinds in which one is triethylenetetramine that is the aliphatic polyamine and another one is the polyamideamine are used. The blending ratio in this case is set so that the polyamideamine becomes greater than the triethylenetetramine. In particular, the triethylenetetramine is approximate 4% (weight) with respect to the polyamideamine.

The solvent of the adhesive layer agent is xylene, methyl isobutyl ketone, isobutanol, ethylene glycol monobutyl ether, toluene or the like. The additive of the adhesive layer agent may be a coupling agent such as silane coupling and the like.

In the golf shaft 1 of the present embodiment, the weight of the element tube 3 is 50%-90% of the weight of the whole of the golf shaft 1 as mentioned above.

If the weight ratio of the element tube 3 exceeds 90%, it is difficult to ensure bending rigidity of the golf shaft 1 required for a golf club according to thinning of the element tube 3 to reduce the weight of the whole of the golf shaft 1 to 50 g-130 g. Accordingly, the golf shaft 1 has the upper limit of the weight ratio set of the element tube 3 to 90%.

The bending rigidity of the golf shaft 1 required for a golf shaft is a resistance to impact at the time of hitting a ball. Accordingly, a golf shaft 1 in which weight ratio of an element tube 3 exceeds 90% cannot ensure such bending rigidity and has a risk to deteriorate hit feeling, to damage in use and the like.

On the other hand, if the weight ratio of the element tube 3 is less than 50%, it is hard to set the wall thickness of the whole of the golf shaft 1 including the element tube 3, the outer layer 7 and the adhesive layer 9 under 1.6 mm (1.5 mm or less in a case of removing digits below the second decimal place).

The golf shaft 1 has good hit feeling if the wall thickness of the whole is set under 1.6 mm, so that the lower limit of the weight ratio of the element tube 3 is 50% capable of setting the wall thickness of the whole under 1.6 mm.

FIG. 4 is a table illustrating wall thicknesses of the outer layer 7, the element tube 3, and the whole in a case that the weight ratio of the element tube 3 is 50%. In addition, FIG. 4 illustrates the wall thicknesses of the outer layer 7, the element tube 3, and the whole which is sum of them for the lengths of the golf shafts 1 being 45 inches, 40 inches, and 35 inches in respective cases that the weights of the golf shafts 1 are 50 g and 130 g.

As illustrated in FIG. 4, in the case that the weight ratio of the element tube 3 is 50%, the wall thicknesses are set under 1.6 mm for any lengths of 45 inches, 40 inches, and 35 inches in the both golf shafts 1, the weights of which are 50 g and 130 g.

Here, the specific gravity of the element tube 3 is about five times as the specific gravity of the outer layer 7 in the present embodiment. Accordingly, in the cases of 130 g and 35 inches, if the wall thickness of the element tube 3 is reduced even a little to reduce the weight ratio, the wall thickness of the outer layer 7 greatly increases to disable the wall thickness of the whole from being set under 1.6 mm in consideration of the wall thicknesses of the plating layer 5 and the adhesive layer 9. With this, it is found that the lower limit of the weight ratio of the element tube 3 is 50%.

FIGS. 5(A)-5(D) are schematic sectional views illustrating manufacturing process of the golf shaft 1.

In the manufacturing of the present embodiment, the element tube 3 having the stepped shape with the outer peripheral surface 3*c* on which the plating layer 5 is formed is prepared as illustrated in FIG. 5(A), first. On the surface of the plating layer 5 of the element tube 3, the adhesive layer agent 15 in which the liquid epoxy resin and the liquid curing agents are mixed is applied as illustrated in FIG. 5(B). The applying of the adhesive layer agent 15 is performed by, for example, ironing. Other applying methods such as spraying may be, however, used.

The adhesive layer agent 15 is the clear paint as mentioned above and is a mixture in which the liquid epoxy resin and the liquid mixed curing agent are mixed in the ratio of 2 to 1.

Next, the prepregs 17 are wound on the surface of the plating layer 5 on which the adhesive layer agent 15 is applied to form a wound product 19 as illustrated in FIG. 5(C).

According to the present embodiment, a plurality of sheets of the prepregs having given cut shapes and dimensions are sequentially wound and stacked around the element tube 3 having the plating layer 5.

Figure 6:
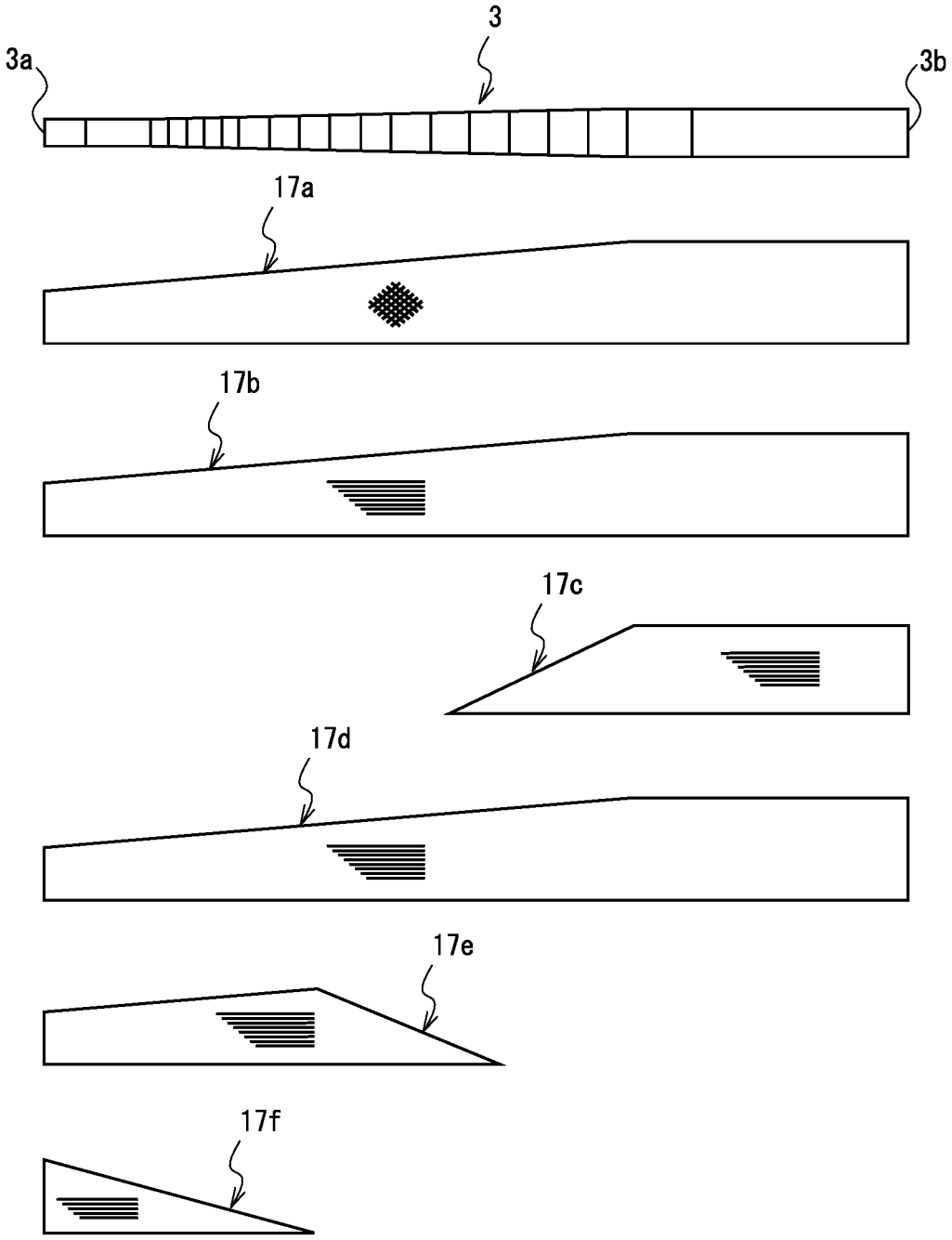
FIG. 6 is a development view illustrating a plurality of sheets of prepregs to be stacked according to the embodiment 1 of the present invention.

FIG. 6 is a development view illustrating the plurality of sheets of the prepregs to be stacked.

According to the present embodiment, the 1st-6th prepregs 17*a*-17*f* having the cut shapes and the dimensions as illustrated in FIG. 6 are sequentially wound around given axial positions of the element tube 3, for example.

The 1st prepreg 17*a* is a stack of two sheets of prepregs of which fibers are oriented at angles of ±45° relatively to the axial direction and is axially entirely wound around the element tube 3.

The 2nd prepreg 17*b* is a sheet of a prepreg of which fiber is oriented in the axial direction and is axially entirely wound around the element tube 3 similarly to the 1st prepreg 17*a*.

The 3rd prepreg 17*c* is a sheet of a prepreg of which fiber is oriented in the axial direction and is wound around a portion from an intermediate to the butt end 3*b* of the element tube 3. The 3rd prepreg 17*c* is stuck to the 4th prepreg 17*d*.

The 4th prepreg 17*d* is a sheet of a prepreg of which fiber is oriented in the axial direction similar to the 2nd prepreg 17*b* and is axially entirely wound around the element tube 3 in a state that the 3rd prepreg 17*c* is stuck thereto.

The 5th prepreg 17*e* is a sheet of a prepreg of which fiber is oriented in the axial direction and is wound around a portion from the tip end 3*a* to the intermediate of the element tube 3.

The 6th prepreg 17*f* is a sheet of a prepreg of which fiber is oriented in the axial direction and is wound around an area which is shorter than for the 5th prepreg 17*e* from the tip end 3*a* to the intermediate.

In this way, the 1st-6th prepregs 17*a*-17*f* are wound around the element tube 3 in the stacked state to form the wound product 19 of FIG. 5(C). It should be noted that multiaxial fabrics such as four-axis or three-axis fabrics may be used as the 1st-6th prepregs 17*a*-17*f* Further, the number of the layers, the shapes, the winding order and the like of the prepregs 17 are an example and may be optionally determined according to performance or the like of a golf club.

A holding tape 21 made of polypropylene or the like is wound on the outer periphery of the wound product 19 to hold the winding state of the prepregs 17 as illustrated in FIG. 5(D).

Then, the wound product 19 around which the tape 21 is wounded is heated in a heating furnace to cure the prepregs 17 and the adhesive layer agent 15, thereby to form the outer layer 7 and the adhesive layer 9.

Thereafter, the tape 21 is removed and adjustment is performed to obtain a desired property by cutting the outer layer 7. At the time of this cutting, winding marks remaining on the outer layer 7 due to the tape 21 are removed to improve quality.

In this way, the golf shaft 1 in which the element tube 3 made of metal is covered with the outer layer 7 made of the fiber reinforced plastic is produced.

Figure 7:
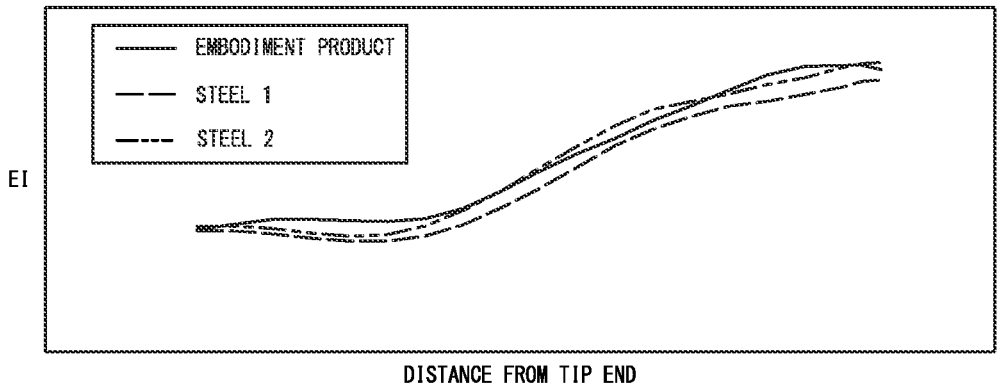
FIG. 7 is a graph schematically illustrating rigidity distribution of golf shafts.

FIG. 7 is a graph schematically illustrating rigidity distribution of golf shafts. In FG. 7, the ordinate represents bending rigidity (EI) and the abscissa represents a distance from a tip end.

In FIG. 7, all of the steel 1, the steel 2, and the embodiment product are 41-inch golf shafts. The steel 1 and the steel 2 represent the golf shafts made of steel and the embodiment product represents the golf shaft 1 according to the embodiment 1 in which the outer layer 7 made of the fiber reinforced plastic is wound around the element tube 3 made of steel as metal as mentioned above.

In the 41-inch golf shafts made of steel, the weights became 120 g according to adjustment of the wall thicknesses to provide the property (rigidity distribution) of FIG. 7. In those made of steel, it is hard to achieve both weight reduction and providing a target property and weight reduction could not be performed further while keeping the property of FIG. 7.

On the other hand, the embodiment product could be reduced the weight to 90 g while providing the property equivalent to of the golf shafts made of steel as illustrated in FIG. 7 by thinning the wall thickness of the element tube 3 made of steel, winding the outer layer 7 made of a fiber reinforced plastic on the outer periphery thereof and grinding the outer layer 7.

Figure 8:
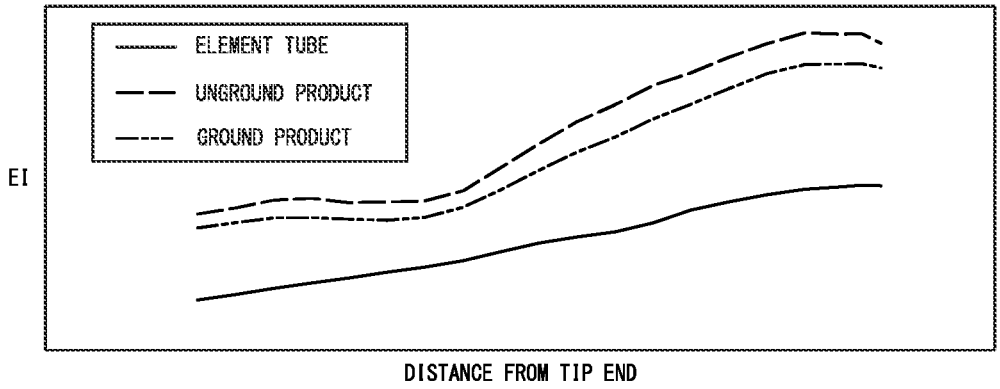
FIG. 8 is a graph illustrating change in rigidity distribution in the manufacturing process.

FIG. 8 illustrates change in rigidity distribution in the manufacturing process. In addition, the ordinate represents bending rigidity (EI) and the abscissa represents a distance from a tip end in FIG. 8 similarly to FIG. 7.

The element tube 3 of the embodiment product has a rigidity approximately linearly increasing from the tip end 3*a* to the butt end 3*b* as illustrated in FIG. 8 by reducing the wall thickness relatively to the steel 1 and the steel 2 (element tube in FIG. 8). The weight of the element tube 3 in this state is 70 g according to the present embodiment.

Then, although the outer layer 7 is wound around the element tube 3 to provide rigidity distribution following the target rigidity distribution, the rigidity distribution at this state is set wholly higher than the target rigidity distribution (unground product of FIG. 8). Thereafter, the property corresponding to FIG. 7 is provided by grinding the outer layer 7 (ground product of FIG. 8). The weight of the golf shaft 1 at this state is 90 g.

The golf shaft 1 of the present embodiment comprises the element tube 3 made of metal, the outer layer 7 covering the outer periphery of the element tube 3 over the entire length of the element tube 3 in the axial direction, the adhesive layer 9 interposed between the element tube 3 and the outer layer 7 to bond between the element tube 3 and the outer layer 7, wherein the weight of the whole including the element tube 3, the outer layer 7, and the adhesive layer 9 is 50 g-130 g, and the weight of the element tube 3 is 50%-90% of the weight of the whole.

The golf shaft 1 of the present embodiment, therefore, ensures the bending rigidity required for a golf club and provides good hit feeling in the composite shaft with 50 g-130 g.

A modification example 1 changes the material of the adhesive layer 9 with respect to the embodiment 1 to a carbon nano tube resin composition. In addition, the modification example 1 is the same as the embodiment 1 with the exception of the material of the adhesive layer 9 and therefore FIGS. 1-3 of the embodiment 1 are referred for the structure to eliminate repetition in description. The wall thickness of the adhesive layer 9 is, however, about 0.06 mm in the present embodiment whereas that in the embodiment 1 is about 0.02 mm.

The carbon nano tube resin composition comprises an epoxy resin and at least one kind of curing agents as well as dispersed carbon nano tubes.

According to the present modification example, not only the amine-based curing agents but also acid anhydride-based curing agents or the like may be used as the curing agents. The carbon nano tubes dispersed in the adhesive layer 9 have outer diameters of approximate 0.5-100 nm and lengths of several nm-several mm.

The adhesive layer 9 of the present modification example is formed by curing a gel adhesive layer sheet 23 with heat. Before the curing, the adhesive layer sheet 23 is a resin film that contains 0.5-10% (weight) carbon nano tubes, preferably 1-5% (weight) carbon nano tubes. It should be noted that the above content ratio of the components is an example and may be changed appropriately.

Figure 9:
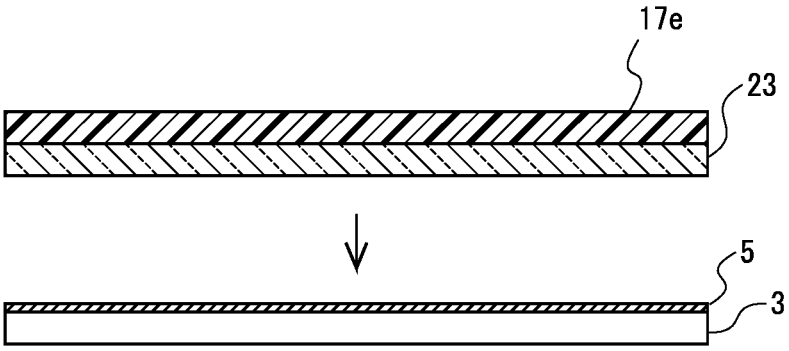
FIG. 9 is a sectional view illustrating a state in which an adhesive layer sheet is stuck on a 1st prepreg at the time of manufacturing a golf shaft according to a modification example 1 of the embodiment 1 of the present invention.

FIG. 9 is a sectional view illustrating a state that the adhesive layer sheet 23 is stuck on the 1st prepreg 17*a* at the time of manufacturing the golf shaft 1.

When manufacturing the golf shaft 1, the adhesive layer sheet 23 is stuck on the 1st prepreg 17*a*, and then the 1st prepreg 17*a* is stuck on the plating layer 5 of the element tube 3 with the adhesive layer sheet 23. Thereafter, the 2nd-6th prepregs 17*b*-17*f* are stacked to form the wound product 19 and heating is conducted thereto after keeping the winding state using the tape 21, and the cured outer layer 7 is ground to provide a desired property similarly to the embodiment 1.

The modification example 1 also provides the same effects as the embodiment 1. Further, according to the modification example 1, the adhesive layer 9 is the carbon nano tube resin composition comprising the epoxy resin and at least one kind of the curing agents as well as the dispersed carbon nano tubes, and therefore it increases strength relative to the embodiment 1.

Figure 10:
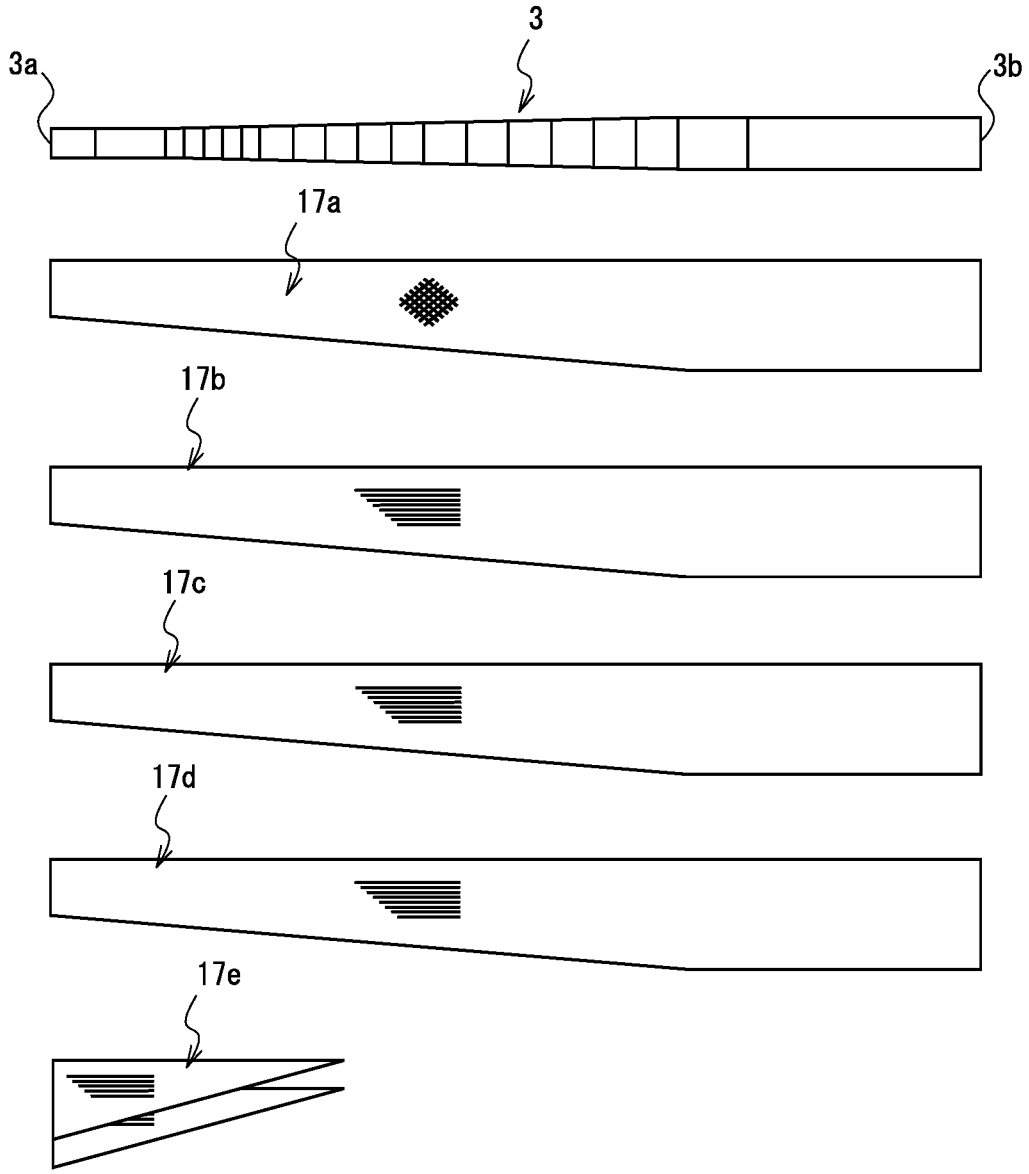
FIG. 10 is a development view illustrating a plurality of sheets of prepregs to be stacked according to a modification example 2 of the embodiment 1 of the present invention.

A modification example 2 changes the stacking number of the prepregs 17 of the outer layer 7 relatively to the embodiment 1. FIG. 10 is a development view illustrating a plurality of sheets of the prepregs to be stacked according to the modification example 2. In addition, the modification example 2 is the same as the embodiment 1 with the exception of the stacking number and the cut shapes of the prepregs 17 and therefore FIGS. 1-3 of the embodiment 1 are referred for the structure to eliminate repetition in description.

According to the modification example, the 1st-5th prepregs 17*a*-17*e* having cut shapes and dimensions as illustrated in FIG. 10 are sequentially wound around given axial positions of the element tube 3.

The 1st prepreg 17*a* is a stack of two sheets of prepregs of which fibers are oriented at angles of ±45° relatively to the axial direction similar to the embodiment 1 and is axially entirely wound around the element tube 3. The 1st prepreg 17*a* is gradually reduced in width (dimension in a circumferential direction of the element tube 3 at the time of winding) from an intermediate closer to the butt end 3*b* to the tip end.

The 2nd-4th prepregs 17*b*-17*d* are individual sheets of prepregs of which fibers are oriented in the axial direction and are axially entirely wound around the element tube 3 similarly to the 1st prepreg 17*a*.

In addition, the 2nd and the 3rd prepregs 17*b* and 17*c* have the same shape in which the widths at the tip end 3*a* and the butt end 3*b* are formed slightly greater than of the 1st prepreg 17*a*. The 4th prepreg 17*d* has the widths at the tip end 3*a* and the butt end 3*b* formed slightly greater than of the 2nd and the 3rd prepregs 17*b* and 17*c*.

The 5th prepreg 17*e* comprises two sheets of prepregs of which fibers are oriented in the axial direction and is wound around an area (tip end portion) from the tip end 3*a* to the intermediate closer to the tip end 3*a* of the element tube 3.

In the 5th prepreg 17*e*, the two sheets of the prepregs having the same triangle shape are not completely stacked so as to be shifted, thereby to disperse overlapping points.

In addition, the shapes and the number of the 1st-5th prepregs 17*a*-17*e* may be appropriately set according to characteristics of the golf shaft 1 similar to the embodiment 1. For example, the 5th prepreg 17*e* may be formed into a trapezoid shape or the like.

In this way, the 1st-5th prepregs 17*a*-17*e* are wound around the element tube 3 in the stacked state, thereby to form the wound product 19 like FIG. 5(C).

The modification example 2 also provides the same effects as the embodiment 1.

The invention claimed is:

1. A golf shaft comprising:

an element tube made of steel;

an outer layer made of a fiber reinforced plastic and covering an outer periphery of the element tube over an entire length of the element tube in an axial direction;

an adhesive layer interposed between the element tube and the outer layer to bond between the element tube and the outer layer, wherein the outer layer comprises cured prepreg sheets wound around the element tube over the adhesive layer, resin being impregnated into each of the prepreg sheets, weight of a whole including the element tube, the outer layer, and the adhesive layer is 50 g-130 g, weight of the element tube is 50%-90% of the weight of the whole, and a wall thickness of the outer layer alters in the axial direction and a wall thickness of the element tube alters in the axial direction.

2. The golf shaft according to claim 1, wherein a wall thickness of the whole including the element tube, the outer layer, and the adhesive layer is under 1.6 mm.

3. The golf shaft according to claim 1, further comprising:

a plating layer formed on the outer periphery of the element tube, wherein the outer layer covers the plating layer, the adhesive layer interposed between the plating layer and the outer layer to bond between the plating layer and the outer layer, the outer layer is formed of a fiber reinforced plastic having a matrix resin that is an epoxy resin, and the adhesive layer is an epoxy resin composition or a carbon nano tube resin composition, the epoxy resin composition comprising an epoxy resin and a mixed curing agent in which two or more kinds of amine-based curing agents are mixed, and the carbon nano tube resin composition comprising an epoxy resin and at least one kind of curing agents as well as dispersed carbon nano tubes.

4. The golf shaft according to claim 1, wherein the wall thickness of the outer layer is set within a range thicker than the wall thickness of the element tube.

5. The golf shaft according to claim 1, wherein the element tube has a butt end and a tip end on both sides in the axial direction and the wall thickness of the element tube is gradually thin toward the butt end.

* * * * *